United States Patent [19]

Erard

[11] 3,945,197

[45] Mar. 23, 1976

[54] TIMEPIECE

[75] Inventor: Raoul-Henri Erard, La Chaux-de-Fonds, Switzerland

[73] Assignee: Ebauches S.A., Neuchatel, Switzerland

[22] Filed: May 8, 1974

[21] Appl. No.: 467,856

[30] Foreign Application Priority Data

May 10, 1973 Switzerland ..... 6784/70

[52] U.S. Cl. ..... 58/59; 58/53

[51] Int. Cl. ..... G04b 33/00

[58] Field of Search ..... 58/59, 53, 88 R

[56] References Cited

UNITED STATES PATENTS

| | | | |
|---|---|---|---|
| 360,477 | 4/1887 | Potter | 58/88 R |
| 3,492,808 | 2/1970 | Wuthrich | 58/59 |
| 3,802,183 | 4/1974 | Erard | 58/59 |

FOREIGN PATENTS OR APPLICATIONS

| | | | |
|---|---|---|---|
| 142,513 | 9/1930 | Switzerland | 58/59 |

*Primary Examiner*—George H. Miller, Jr.
*Attorney, Agent, or Firm*—Silverman & Cass, Ltd.

[57] ABSTRACT

A timepiece including a casing having a main part with an element in relief to receive the timepiece movement. The casing element supports at least a part of the shafts of the timepiece movement gearing. The element has at least one bridge of the movement frame to maintain the gearing with at least one other bearing surface for another element of the movement.

3 Claims, 7 Drawing Figures

TIMEPIECE

The present invention relates to a timepiece.

This timepiece is characterized by the fact that the main part of the frame of its movement is constituted by an element of its casing showing a relief adapted to the relief of the elements of the movement, this element of the casing supporting at least a part of the shafts of the gearing of the movement and being provided with at least one bearing surface for at least one bridge of the frame of the movement maintaining the said gearing and with at least one bearing surface for an element of the movement.

The drawing shows, by way of example, one embodiment of the object of the invention.

Figure 1:
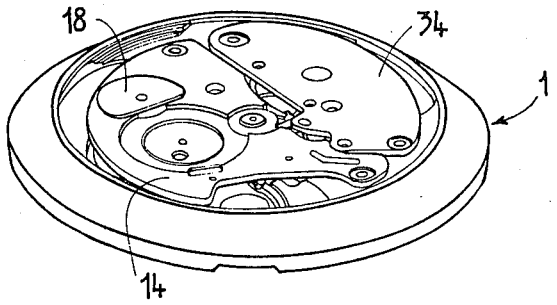
FIG. 1 is a perspective view of a part of a wrist-watch.
Figure 2:
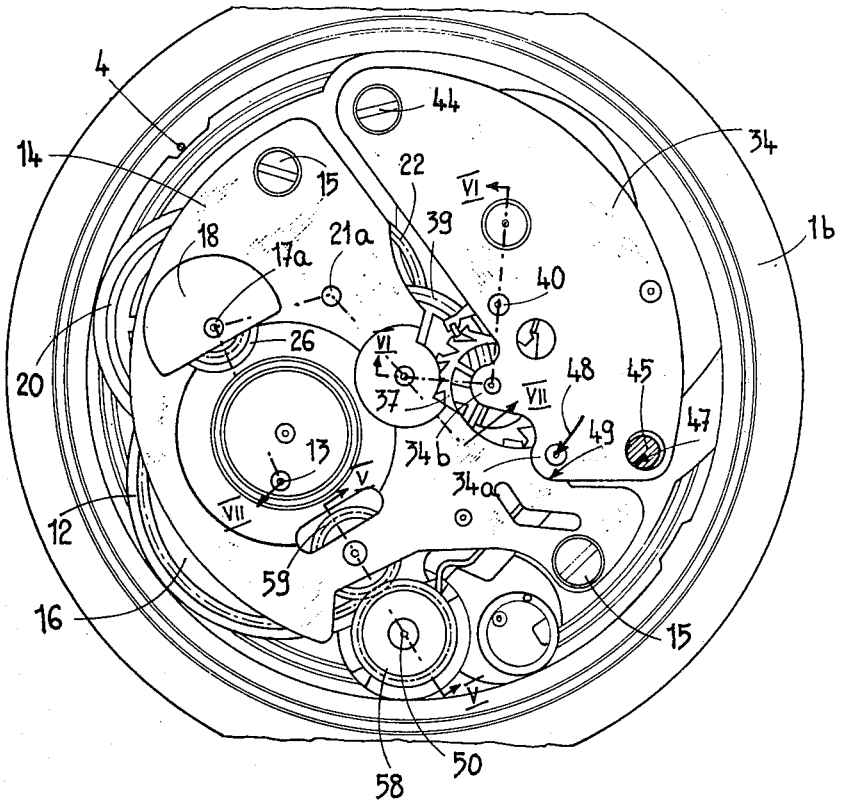
FIG. 2 is a plan view thereof, at a larger scale.

The casing of the watch represented is constituted by a cap 1, made of plastic material, provided with a bottom 1*a* and with an annular edge 1*b* carrying the glass, designated by 2, which maintains in place the dial, designated by 3, resting by its periphery on an inner shoulder of the edge 1*b* (FIG. 7), on which it is angularly positioned by a stud 4 (FIG. 2). This cap 1 constitutes, with the glass 2, a casing of the type known under the name of "container" intended to be located either in an outer casing or merely in a middle part provided, especially, by the means of attaching of the bracelet.

Figure 3:
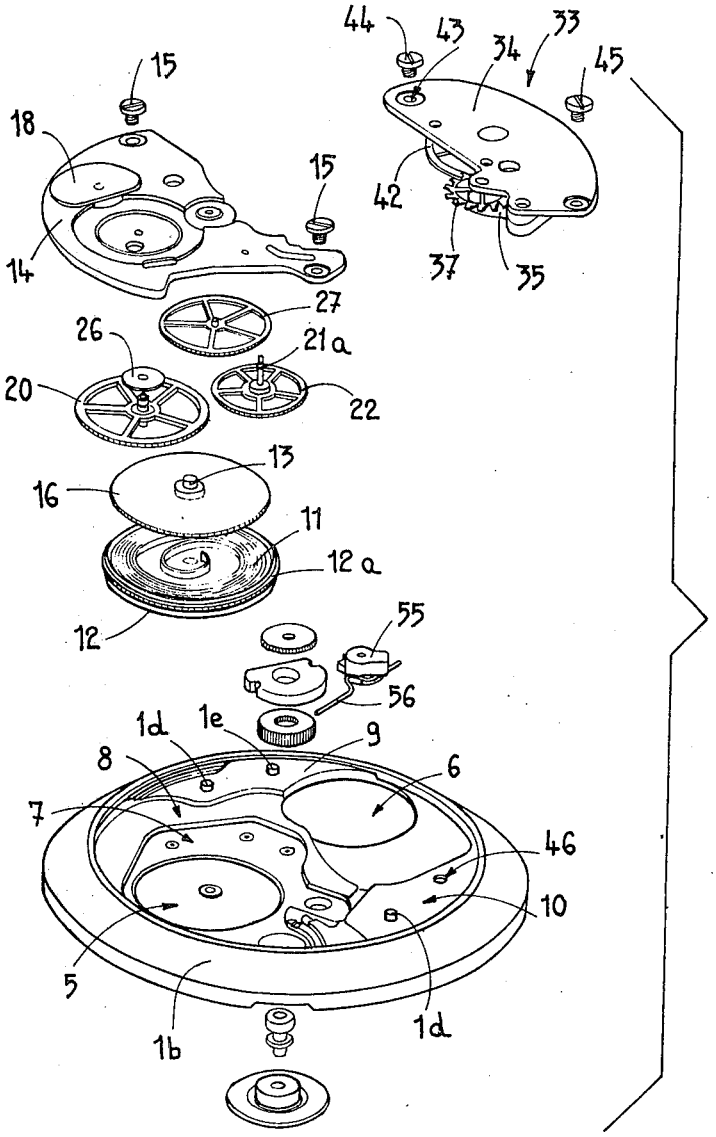
FIG. 3 is an exploded view thereof, at the scale of FIG. 1.

The bottom 1*a* of the cap 1 constitutes an element of the frame of the movement, more precisely the main part of this frame. As shown by FIG. 3, this bottom 1*a* has a relief which depends from the topography of the movement, that is to say which is provided with portion situated at different levels giving passage to elements of the movement. Thus, the bottom 1*a* is provided with a circular recess 5 intended to receive the barrel containing the motor spring, a circular recess 6 in which is located the balance-wheel, a zone 7 receiving the bearings of the several shafts of the gearing of the movement, an intermediary zone 8 constituting a stiffening extra thickness, and two bearing surfaces 9 and 10, the role of which will be indicated later, which are parallel to the plane of the movement and which are situated in a common plane.

Figure 7:
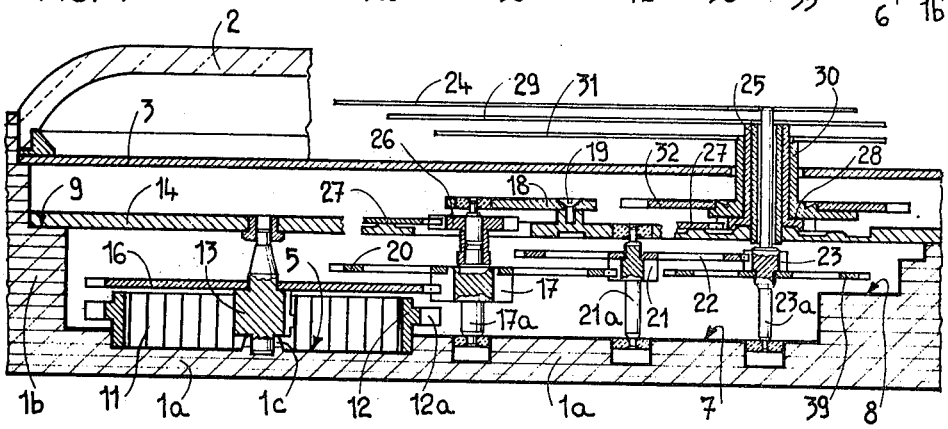

The motor spring, represented at 11 in FIG. 7, is located in a barrel constituted merely by a ring 12, opened on its both sides, partially engaged in the recess 5 of the bottom 1*a* of the cap 1. The shaft of the barrel, designated by 13, is pivoted on the one hand in an embossment 1*c* shown by the bottom 1*a* of the cap 1, at the centre of the recess 5, and on the other hand in a metallic bridge 14 bearing on the bearing surfaces 9 and 10 of the bottom 1*a* of the cap 1. This bottom 1*a* is provided with two tubular studs 1*d*, substantially diammetrically opposed with respect to the centre of the movement, ensuring the centering of the bridge 14, which is maintained in place by two screws 15. This bridge being situated under the dial, it plays, partially, the role of the base-plate of the conventional movements while the bottom 1*a* of the cap 1 plays, partially, the role of the conventional bridges.

The shaft 13 of the barrel carries, forced thereon, a wheel 16 meshing with the pinion, designated by 17, of the minutes, which is not situated in the centre of the movement, as in the conventional watches, but out from this centre. The shaft 17*a* of the minutes, made of one piece with the pinion 17, is pivoted between the bottom 1*a* of the cap 1 and a small plate 18 secured, by a screw 19 (FIG. 7), to the bridge 14. This shaft 17*a* carries a wheel 20 meshing with the pinion 21 of the third wheel, the shaft of which, designated by 21*a*, is pivoted between the bottom 1*a* of the cap 1 and the bridge 14. This shaft carries a wheel 22 meshing with the pinion 23 of the centre seconds, the shaft 23*a* of which, carrying the seconds hand, designated by 24, is supported on the one hand by the bottom 1*a* of the cap 1 and on the other hand by a sleeve 25 secured to the bridge 14.

The minutes shaft 17*a* being not situated in the centre of the movement, as it has been said, it carries a cannon-pinion 26, meshing with an intermediate wheel 27 (FIG. 7) meshing with a second cannon-pinion 28, the cannon of which carries the minutes hand designated by 29. The hour-wheel, designated by 30, carrying the hand 31 of the hours, is engaged on the second cannon-pinion 28. Its wheel 32 is meshing with the pinion of a dial-train, not represented, the wheel of which is meshing with the second cannon-pinion 28.

The regulating device of the watch as disclosed and represented is constituted by an independent modular element, represented in 33 in FIG. 3. The frame of this modular element comprises a metallic main plate 34, a metallic bridge 35, secured to the plate 34, and a balance-cock 36, secured to the bridge 35 which operates as a distance-piece. This regulating module comprises an escape wheel 37 forced on the shaft 38*a* of a pinion 38 meshing with a seconds wheel 39 carried by the shaft 23*a* of the centre seconds. The shaft 38*a* is pivoted between the main plate 34 and the bridge 35, as is also the shaft, designated by 40, of the pallets 41. The balance-wheel, designated by 42, is pivoted between the main plate 34 and the balance-cock 36. As a modification, the regulating module could be provided with means permitting to adjust the timing of the watch, permitting to act on the active length of the hair-spring.

The regulating module is supported by the bottom 1*a* of the cap 1 bearing on the two bearing surfaces 9 and 10 of this bottom 1*a*. The surface 9 is provided with a tubular stud 1*e*, similar to the studs 1*d* ensuring the centering of the bridge 14 and on which is engaged, by means of a hole 43 provided therein to this effect, the main plate 34. A screw 44 maintains it in position. At its opposite end, the plate 34 is maintained in place by a screw 45 screwed in a hole 46 provided in the bearing surface 10 of the bottom 1*a* of the cap 1; this screw 45, sectionally shown in FIG. 2, is provided with a conical bearing surface by means of which it engages the edge of the hole, designated by 47, of the plate 34 traversed by this screw. Owing to this arrangement, the main plate 34 of the frame of the regulating module is pressed, in the direction of the arrow 48 of FIG. 2, towards the bridge 14. It bears, by means of a nose 34*a* constituting a centering means, against a gearing surface 49 (FIG. 4) perpendicular to the plane of the movement, provided on the bridge 14. There results that the penetration of the toothing of the seconds wheel 39 into the pinion 38 of the escape wheel 37 is very precisely determined by the dimension of the centering nose 34a and by the position of the bearing surface 49, independently from any other dimension of the several elements of the movement. As a modification, one could also have the centering ensured not by means of the nose 34a of the plate 34, which is situated close from point of pivoting of the escape wheel 37, but by a portion 34b of this plate which is coaxial to the escape wheel. This head 34b would then cooperate with a bearing surface of the bridge 14 similar to the bearing surface 49, that would have the advantage that the operating of the regulating device would not be troubled by imprecisions of manufacture which could bring its position to vary angularly with respect to the axis of the escape wheel.

Figure 5:
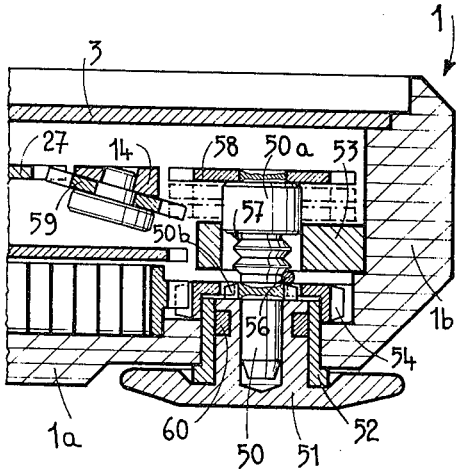
FIGS. 5, 6 and 7 are sectional views along lines V—V, VI—VI and VII—VII, respectively, of FIG. 2, at a larger scale.
Figure 6:
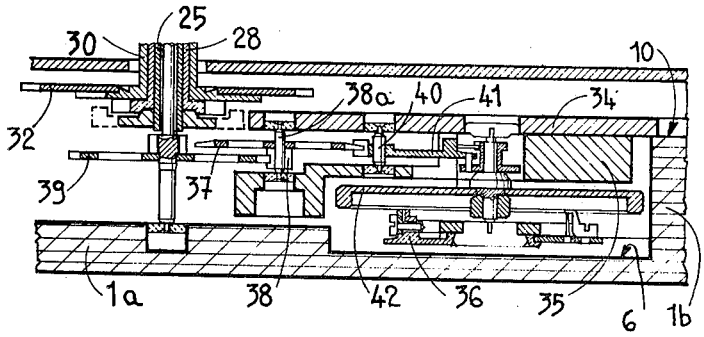

The watch represented comprises moreover a control stem 50 (FIG. 5), perpendicular to the plane of the movement, able to occupy several axial positions, permitting to effect, according to its position, the winding, the setting or the correction of the indicating members of a calendar, the mechanism of which has not been represented. The stem 50 carries a control crown 51 by means of which it is rotatably mounted in a sleeve 52 forced in the bottom 1a of the cap 1. The stem 50 is provided, at its end opposite to this one carrying the crown 51, with a portion of larger diameter 50a rotating in a small plate 53 carried by the lateral part 1b of the cap 1.

The sleeve 52 carries, rotatably mounted on its inner end, a pinion 54 traversed by a toothing 50b provided on the stem 50, this pinion meshing with a toothing 12a of the ring 12 constituting the barrel. In one of the axial positions of the stem 50, represented in FIG. 5, its toothing 50b is meshing with a corresponding inner toothing of the pinion 54, that permits, while operating the control crown 51, to effect the winding. A pole 55 (FIG. 3) acts on the pinion 54 for retaining the motor spring 11, the return spring of this pole, designated by 56, cooperating, like a jumper, with one or the other of several conical surfaces 57 of the stem 50, for ensuring the stability of the several axial positions of this stem. The stem 50 carries, at its end opposed to this one carrying the control crown 51, a wheel 58 meshing, in the pulled position of the stem, with a setting intermediate wheel 59, carried by the bridge 14, the axis of which is inclined with respect to the plane of the movement, and which is meshing with the intermediate wheel 27 connecting the cannon-pinion 26 carried by the minutes shaft 17a to the second cannon-pinion 28 coaxial to the centre of the movement.

The mounting of the timepiece as disclosed and represented is effected while mounting first the several elements of the control mechanism, that is to say the stem 50 and the pinions 54 and 58. One can then effect a checking of the tightness of this mechanism, this tightness being ensured by a joint 60 interposed between the crown 51 and the sleeve 52, without the other elements of the movement being already in place and without, therefore, there is a risk of damaging them by this checking which is effected, generally, by deeping into a liquid. This checking will be so more useful that the stem 50 has not, later, to be separated anew.

The mounting is then continued while placing the barrel, the shaft of the barrel, and the three first elements of the gearing. The bridge 14 is then put in place, that maintains the whole. One can then check all the operations of the control mechanism as well as the freedom of the gearing of the movement.

Figure 4:
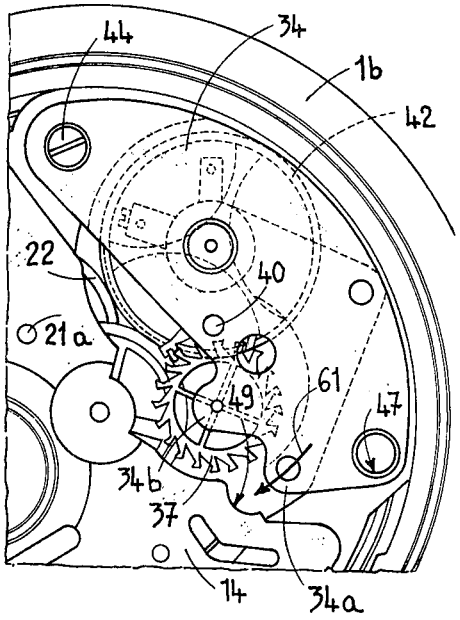
FIG. 4 is a plan view of a part of this watch, during its mounting.

The mounting is continued while putting in place the regulating module 33, which will have been mounted and checked previously, which is engaged in the space provided for it in the position represented in FIG. 4, in which the pinion 38 of the escape wheel is not meshing with the wheel 39 of the seconds. Thus, the regulating module can be put in place entirely mounted, without there is a risk that any of its elements be damaged. It is maintained by the screw 44, which is not tightened, then the screw 45 is put in place, moving the regulating module in the direction of arrow 61 of FIG. 4. When the centering nose 34a of the main plate 34 is strongly applied against the bearing surface 49 of the bridge 14 by the conical bearing surface of the screw 45 acting on the edge of the hole 47 of the plate 34, the screw 44 is then tightened. It is to be noted that, owing to this arrangement, the main plate 34 constitutes, with the bridge 14, a rigid assembly, these two elements contributing, together, to ensure the rigidity of the frame of the movement.

In the example as disclosed and represented, the cap 1 is made of plastic material and the bridge 14 of metal, but the reverse could be executed as well as the whole could be made of metal or the whole of plastic material.

In this example, the bearing members of the bearings of the gearing are secured on element 1a of the frame or on the bridge 14. They could, when these portions of the frame are made of plastic material, be made of one piece therewith or be molded in situ thereon.

As a modification, one could provide the case where the regulating module will be definitely and unremovably secured to the bottom 1a of the cap 1, by means of studs, or by welding or sticking for example.

The present arrangement will be usable not only for wrist-watches, but also for pocket watches pendant watches or other timepieces as, for instance, minature clocks.

What I claim is:

1. A timepiece including in combination, a casing (1) forming a part of the movement frame with the casing bottom (1a) forming the main part of the movement frame, the casing bottom including a relief formed therein and adapted to the relief of the elements of the movement, said casing bottom supporting at least a part of the shafts of the gearing of the movement and being provided with at least one bearing surface (9) for supporting at least one bridge (14) of the frame of the movement and for maintaining the said gearing in position and with at least one bearing surface (10) for an element (33) of the movement, the bearing surface (10) of the element (33) of the movement constitutes a second bearing surface for the said bridge (14) of the frame, while the bearing surface (9) for the bridge (14) constitutes a second bearing surface for the said element (33) of the movement.

2. A timepiece including in combination, a casing (1) forming a part of the movement frame with the casing bottom (1a) forming the main part of the movement frame, the casing bottom including a relief formed therein and adapted to the relief of the elements of the movement, said casing bottom supporting at least a part of the shafts of the gearing of the movement and being provided with at least one bearing surface (9) for supporting at least one bridge (14) of the frame of the movement and for maintaining the said gearing in position and with at least one bearing surface (10) for an element (33) of the movement, said element (33) of the movement bearing on the bearing surface (10) of the main portion (1*a*) of the frame of the movement is constituted by a regulating module.

3. A timepiece including in combination, a casing (1) forming a part of the movement frame with the casing bottom (1*a*) forming the main part of the movement frame, the casing bottom including a relief formed therein and adapted to the relief of the elements of the movement, said casing bottom supporting at least a part of the shafts of the gearing of the movement and being provided with at least one bearing surface (9) for supporting at least one bridge (14) of the frame of the movement and for maintaining the said gearing in position and with at least one bearing surface (10) for an element (33) of the movement, the two bearing surfaces (9 and 10) of the main portion (1*a*) of the frame of the movement being situated in the same plane.

* * * * *